United States Patent [19]

Schnitzer et al.

[11] 4,367,867

[45] Jan. 11, 1983

[54] COOLING SUPPORT ELEMENTS FOR METALLURGICAL FURNACE

[75] Inventors: Heinrich Schnitzer, Rheinberg; Volker Mauermann, Kempen, both of Fed. Rep. of Germany

[73] Assignee: Mannesmann Aktiengesellschaft, Dusseldorf, Fed. Rep. of Germany

[21] Appl. No.: 300,023

[22] Filed: Sep. 8, 1981

[30] Foreign Application Priority Data

Sep. 27, 1980 [DE] Fed. Rep. of Germany ..... 3036564

[51] Int. Cl.[3] ..... C21B 7/10

[52] U.S. Cl. ..... 266/190; 266/241

[58] Field of Search ..... 266/190, 241; 75/10–12, 88; 13/32, 8

[56] References Cited

U.S. PATENT DOCUMENTS

| | | | |
|---|---|---|---|
| 3,169,015 | 2/1965 | Henry | 266/190 |
| 3,271,134 | 9/1966 | Derham | 75/88 |
| 4,207,060 | 6/1980 | Zangs | 266/241 |
| 4,304,396 | 12/1981 | Udoh | 266/241 |

*Primary Examiner*—P. D. Rosenberg

*Attorney, Agent, or Firm*—Mandeville and Schweitzer

[57] ABSTRACT

A metallurgical furnace is equipped with interconnected cooling pipes which are supported by structure which includes horizontal rings arranged as a cage around the furnace.

3 Claims, 2 Drawing Figures

COOLING SUPPORT ELEMENTS FOR METALLURGICAL FURNACE

BACKGROUND AND SUMMARY OF THE INVENTION

Conventional arc furnaces are provided with a refractory brick lining covering the interior wall of the furnace vessel. This brick lining wears down in the course of the furnace operation because of the chemical and thermic stresses to which it is exposed. The part of the vessel wall above the melting zone has, therefore, been provided with cooling pipes lying closely adjacent to each other in the manner of a pipe coil for example. The surface structures consisting of pipes represent segment-type wall elements fastened to a support structure. This support structure is constructed as an installation at the melting zone which forms the vessel, refractorily lined and provided with a steel jacket, and consists of hollow bodies which are rectangular in their cross section, said bodies welded together with flat plates and with cooling liquid flowing through said hollow bodies.

Due to the voluminous welding operation involved, the manufacture of this support structure is expensive and time consuming. Lately the question of energy recovery in metal-melting furnaces, particularly arc furnaces, has greatly gained in importance. Up to the present, however, the cooling-water circulation has been regulated in such a manner that the cooling water was heated up without turning to steam.

The objective of the present invention is to develop the support structure of a metal-melting furnace in a simple manner so that said structure is capable of delivering cooling water which has absorbed a substantially higher degree of heat so that correspondingly more energy may be recovered from said water.

The present invention solves this problem in that the support structure is made of pipes forming a cage comprising horizontal rings superposed, in intervals, on each other and connected through pipes. The present invention is based on the recognition that a box-shaped support structure, consisting of structural elements which are rectangular in cross section, does not withstand the pressures caused by cooling water which is heated to a higher degree because the bursting limit of the rectangular "pipes" forming the structure is too low. In contrast, the present invention makes it possible to use conventional pipes for manufacturing the support structure, thus on the one hand, simplifying and lowering the cost of production, and yet, on the other hand, achieving substantially higher water temperatures because higher internal pressure is achievable.

The present invention is described with the aid of an embodiment example.

DETAILED DESCRIPTION OF THE INVENTION

Figures 1, 2:
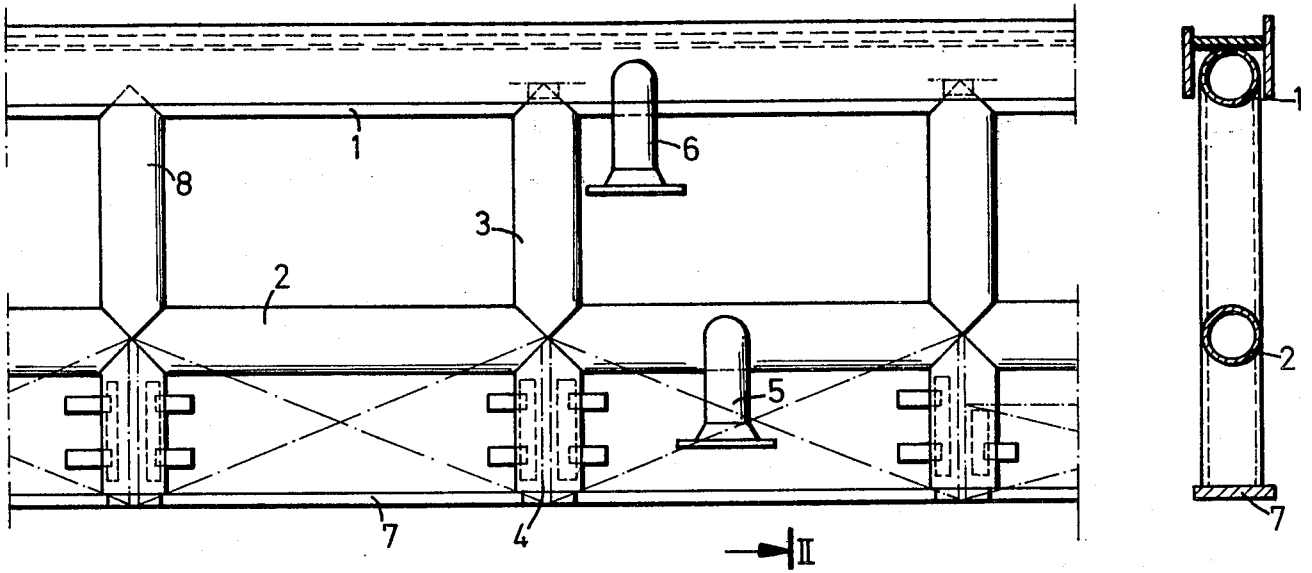
FIG. 1 is a view of the support structure according to the invention, the view taken from outside the furnace.
FIG. 2 is a vertical cross section of the support structure of FIG. 1 taken along the lines II—II.

The support structure for the installation, on an arc furnace, of cooling pipes distributed in a plane, according to FIG. 1, comprises two horizontal rings arranged one on top of the other, separated by a space. Each ring comprises a pipe, i.e., the upper ring of pipe 1 and the lower ring of pipe 2. The pipes 1, 2 are interconnected through vertically extended connecting pipes 3. Furthermore, short support pipes 4, ending at a round plate and connected thereto, are respectively located at the lower pipe 2 as an extension of connecting pipes 3. The support structure is also equipped with a cooling-water feed-in 5 and a cooling-water drainage 6. The arrangement is complemented by re-enforcement sheets 8 which lend additional firmness to the cage-like support structure comprising pipes. The embodiment according to FIG. 1 shows the support structure viewed from outside the furnace.

As is shown in FIG. 2, the support structure, with the ring-shaped support plate 7, rests on the upper side of the furnace element receiving the metal melt. The cooling elements which are formed by the pipe coils are suspended in the interior, i.e., in FIG. 2 on the left, from the support structure. Not only may the flat-shaped wall elements (not illustrated), consisting of pipe coils, easily be exchanged, if need be, but it is also possible to remove the entire cage-like support structure from the furnace.

The particular advantage of the support construction, according to the invention, resides in the fact that it may be made from conventional pipes which are of correspondingly high bursting strength. It is, therefore, possible to heat the cooling water circulating in the pipes 1, 2, 3, 4 to a high degree which produces a corresponding internal pressure in the system in order then to recover the heat energy stored there. Added to this is the fact that the support structure of pipes is essentially lighter in weight than the arrangements in previously executed welding structures, and that it may be made in a simpler and more economical manner.

We claim:

1. In a metallurgical furnace in which the interior wall of the furnace, above the melting zone, is provided with interconnected cooling pipes which are supported on a skeletal support structure, the improvement characterized by (a) said support structure comprises horizontal rings configured as a cage around said furnace;

(b) said rings are constructed from pipe-shaped segments; and (c) said horizontal rings are positioned at vertically spaced intervals from one another.

2. In a metallurgical furnace as claimed in claim 1, the improvement further characterized by (a) said interconnecting pipes and said horizontal rings being in fluid communication; and (b) said support structure is provided with at least one cooling water inlet and cooling water drain.

3. In a metallurgical furnace as claimed in claim 1, the improvement further characterized by (a) said pipe-shaped segments are capable of withstanding an internal pressure of about 10 atmospheres.

* * * * *